US007900551B2

(12) United States Patent
Benz et al.

(10) Patent No.: US 7,900,551 B2
(45) Date of Patent: Mar. 8, 2011

(54) PISTON FOR AN INTERNAL COMBUSTION ENGINE

(75) Inventors: Arnold Benz, Aichwald (DE); Helmut Kollotzek, Mutlangen (DE); Markus Leitl, Remshalden (DE); Sven Schilling, Korb (DE); Ernst Limbach, Remshalden (DE); Josip Zvonkovic, Weinstadt (DE)

(73) Assignee: Mahle International GmbH, Stuttgart (DE)

( * ) Notice: Subject to any disclaimer, the term of this patent is extended or adjusted under 35 U.S.C. 154(b) by 355 days.

(21) Appl. No.: 12/086,843

(22) PCT Filed: Dec. 15, 2006

(86) PCT No.: PCT/DE2006/002254

§ 371 (c)(1),
(2), (4) Date: Jul. 10, 2008

(87) PCT Pub. No.: WO2007/076811

PCT Pub. Date: Jul. 12, 2007

(65) Prior Publication Data

US 2009/0007776 A1 Jan. 8, 2009

(30) Foreign Application Priority Data

Dec. 21, 2005 (DE) ..... 10 2005 061 059

(51) Int. Cl.
*F01B 31/08* (2006.01)

(52) U.S. Cl. ..... 92/186

(58) Field of Classification Search ..... 92/159, 92/186; 123/41.35

See application file for complete search history.

(56) References Cited

U.S. PATENT DOCUMENTS

| | | | | |
|---|---|---|---|---|
| 4,206,726 | A | 6/1980 | Johnson, Jr. et al. | |
| 4,253,429 | A | 3/1981 | Galli | |
| 4,428,330 | A | 1/1984 | Shimizu | |
| 6,250,275 | B1 | 6/2001 | Bock et al. | |
| 6,324,961 | B1 | 12/2001 | Akimoto et al. | |
| 6,491,013 | B1 * | 12/2002 | Gaiser et al. | 92/186 |
| 6,513,477 | B1 | 2/2003 | Gaiser et al. | |
| 7,051,684 | B2 | 5/2006 | Bauer | |
| 2003/0051694 | A1 | 3/2003 | Gaiser et al. | |
| 2004/0040520 | A1 * | 3/2004 | Bontaz et al. | 123/41.35 |

FOREIGN PATENT DOCUMENTS

| | | |
|---|---|---|
| AT | 164 393 | 11/1949 |
| CH | 339 430 | 8/1959 |
| DE | 1 725 611 | 7/1956 |
| DE | 1 905 609 | 8/1970 |
| DE | 28 31 566 | 2/1979 |
| DE | 29 09 003 | 10/1979 |
| DE | 37 19 469 | 12/1988 |
| DE | 37 32 927 | 4/1989 |
| DE | 195 22 756 | 1/1997 |
| DE | 197 32 880 | 1/1999 |

(Continued)

OTHER PUBLICATIONS

International Search Report.

*Primary Examiner* — Michael Leslie
(74) *Attorney, Agent, or Firm* — Collard & Roe, P.C.

(57) ABSTRACT

A piston for an internal combustion engine has an annular cooling channel provided with oil admission boreholes and oil discharge boreholes, the oil discharge boreholes being oriented in the direction of the bolt hubs for the cooling thereof.

5 Claims, 3 Drawing Sheets

FOREIGN PATENT DOCUMENTS

Figure 1:
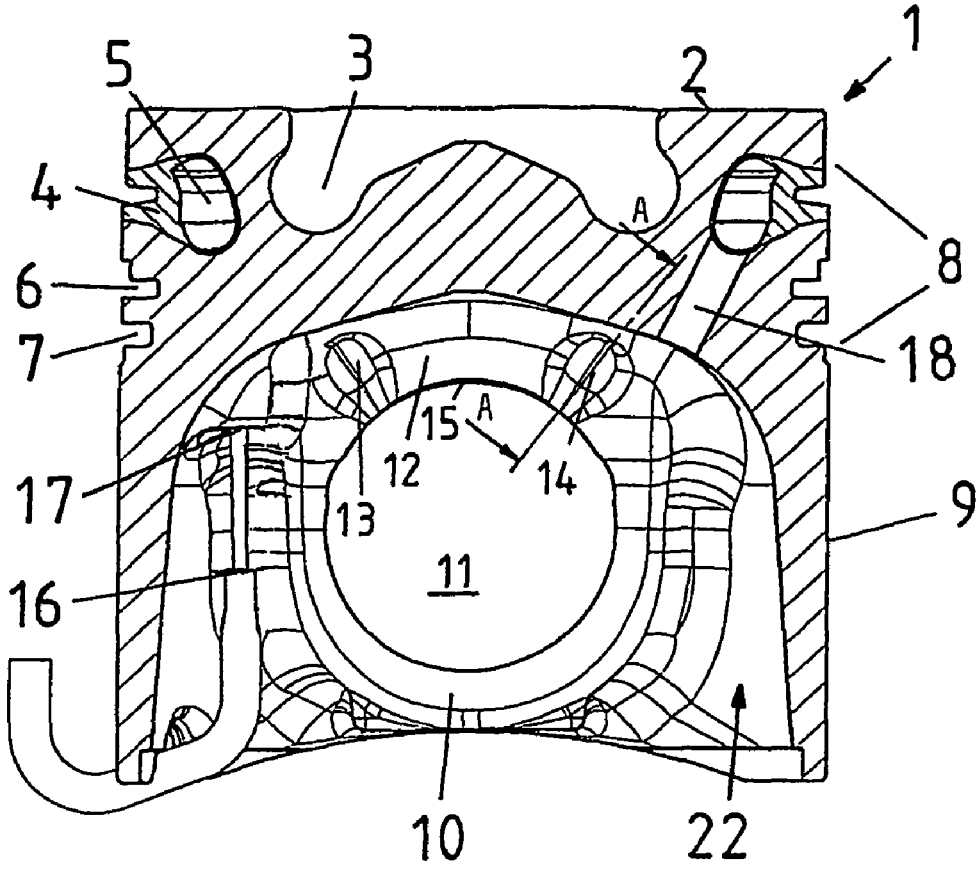

| | | |
|---|---|---|
| DE | 102 14 830 | 1/2004 |
| DE | 103 23 734 | 12/2004 |
| DE | 600 25 419 | 8/2006 |
| EP | 1 077 324 | 2/2001 |
| FR | 1 454 468 | 8/1965 |
| GB | 2 205 922 | 12/1988 |
| JP | 04-116253 | 4/1992 |
| JP | 09-072215 | 3/1997 |
| JP | 09-079116 | 3/1997 |

* cited by examiner

PISTON FOR AN INTERNAL COMBUSTION ENGINE

CROSS REFERENCE TO RELATED APPLICATIONS

This application is the National Stage of PCT/DE2006/002254 filed on Dec. 15, 2006, which claims priority under 35 U.S.C. §119 of German Application No. 10 2005 061 059.5 filed on Dec. 21, 2005. The international application under PCT article 21(2) was not published in English.

The invention relates to a piston for an internal combustion engine, in accordance with the preamble of claim 1.

A piston is known from the published application DE 102 14 830 Al, which has a ring-shaped cooling channel disposed in the edge region on the piston crown side, which channel has an oil inlet opening on the side facing away from the piston crown, by way of which opening an oil spray nozzle sprays cooling oil into the cooling channel. The cooling channel is delimited radially on the outside by a molded-on part that carries the ring belt, and radially on the inside by the piston crown shaped to configure the combustion bowl, so that cooling oil flowing in the cooling channel can only cool the ring belt and the radially outer region of the combustion bowl.

A piston is known from the Japanese patent application JP 09 079116, in which the entire underside of the piston crown has cooling oil sprayed onto it, and is thereby cooled.

It is a disadvantage in this connection that neither in the Offenlegungsschrift DE 102 14 830 nor in the Japanese patent application JP 09 079116 are any measures provided that serve for cooling the pin bosses.

Proceeding from this, the invention is based on the task of avoiding the stated disadvantage of the state of the art. This task is accomplished with the characteristics that stand in the characterizing part of the main claim and the secondary claim. Practical embodiments of the invention are the object of the dependent claims.

Figure 2:
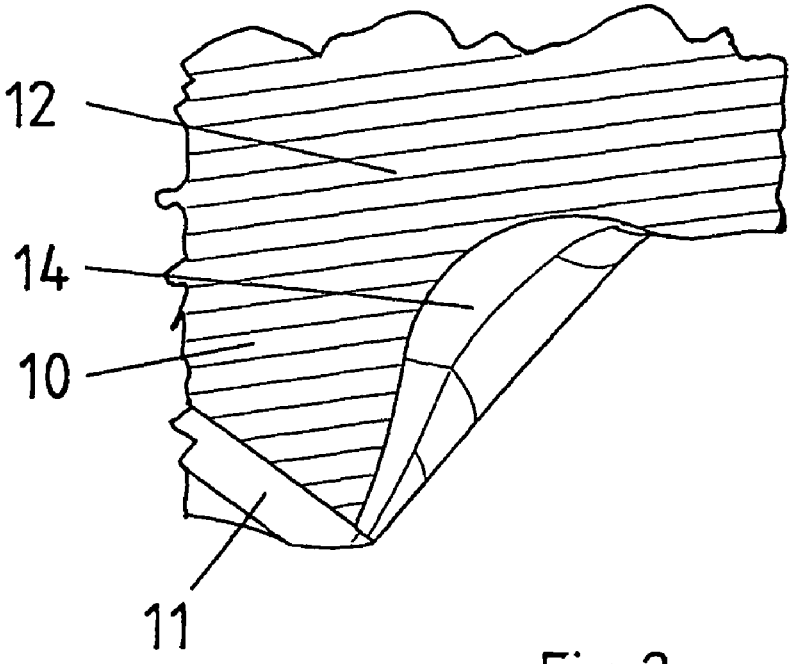
Figure 3:
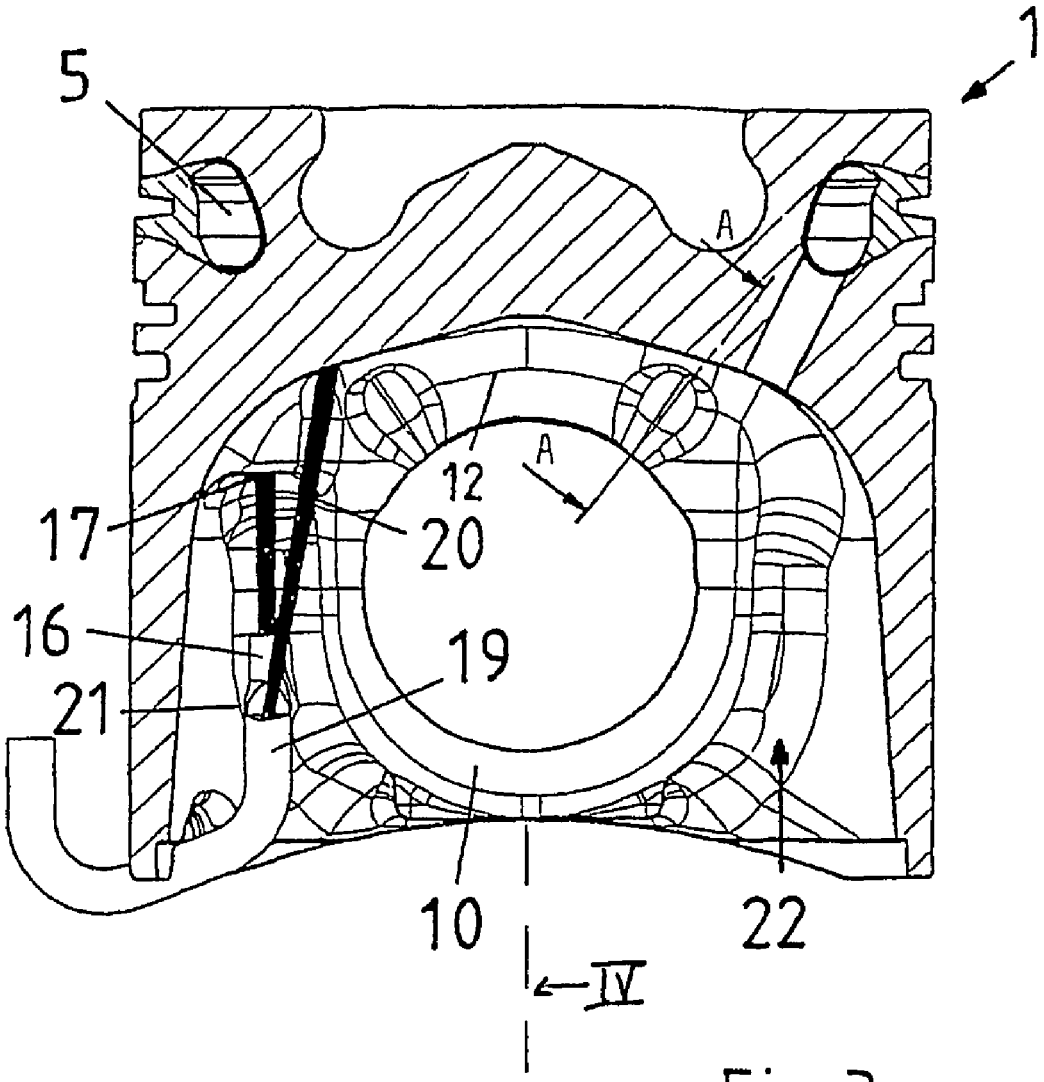

Some exemplary embodiments of the invention will be described below, using the drawing. This shows:

FIG. 1 a section through a piston having a cooled ring insert, whose run-off bore is directed at the upper pin boss region, so that the oil running off out of the cooling channel of the ring insert can be used to cool the pin boss, FIG. 2 a section along the line AA in FIG. 1, which shows an oil pocket formed into the upper pin boss region, whose function consists in storing oil for lubricating the piston pin, and FIG. 3 the piston according to FIG. 1 in section, in which the oil spray nozzle for introducing cooling oil into the cooling channel of the cooled ring inert is connected with another spray nozzle directed at the upper pin boss region, to form a double spray nozzle.

Figure 4:
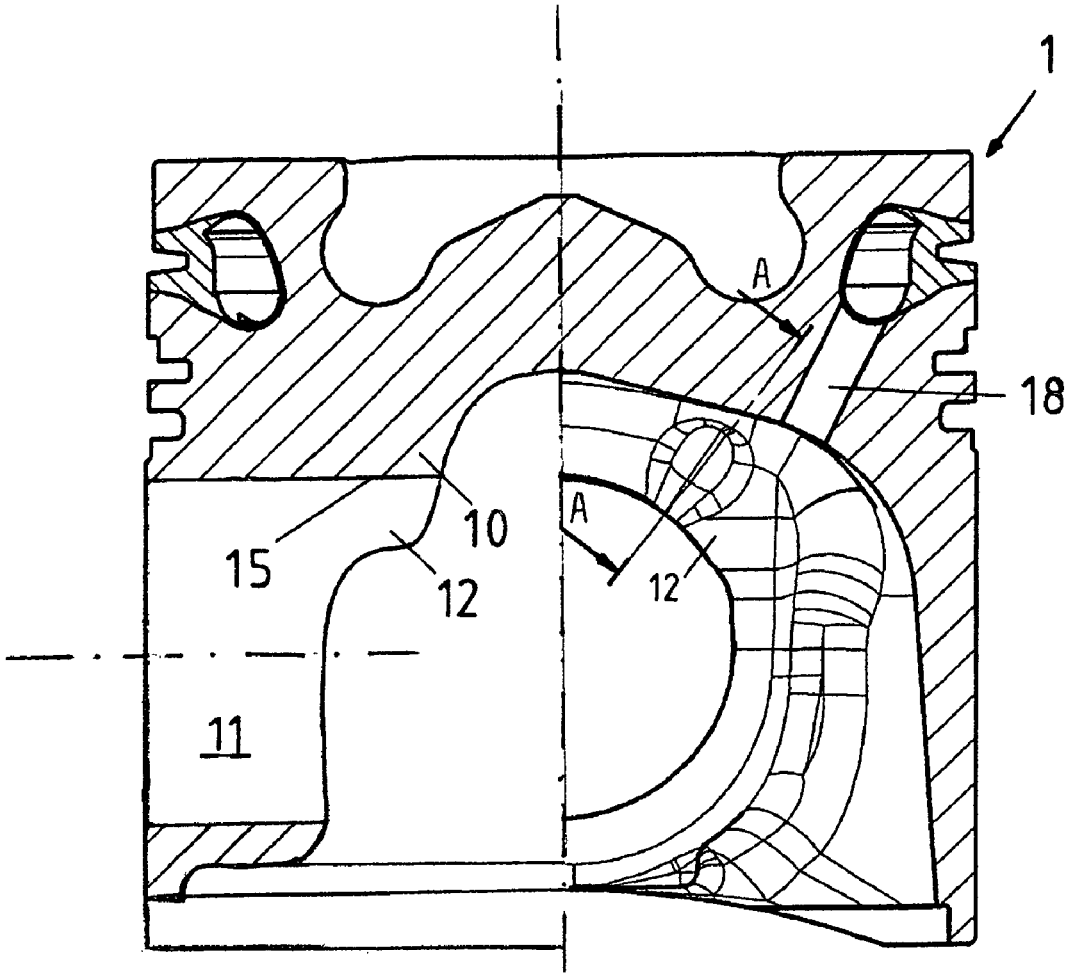

FIG. 4 a section on the left side of the drawing along line IV-IV from FIG. 3 where the right side of the drawing is identical to the right side of FIG. 3.

FIG. 1 shows a sectional diagram of a piston 1 for an internal combustion engine, in the piston crown 2 of which a combustion bowl 3 is formed. The piston 1 can consist of steel, gray cast iron, aluminum or another light metal, such as magnesium, for example. In the piston-crown-side edge region of the piston 1, a cooled ring insert 4 for a compression ring, not shown in the figure, is disposed, which insert has a ring-shaped cooling channel 5 radially on the inside. Facing away from the piston crown, the ring insert 4 is followed by a second groove 6 for another compression ring, and a third groove 7 for an oil control ring. A rotating piston skirt 9 is connected with the ring belt 8 formed from the ring insert 4 and the grooves 6 and 7, which skirt has a pin boss 10, in each instance, formed into the sides that lie radially opposite one another, each pin boss having a pin bore 11.

The piston-crown-side regions 12 of the pin bosses 10 are reinforced radially on the inside, as can be seen particularly well also in FIG. 4 (a section through the piston shown in FIG. 3, along the line IV-IV), thereby resulting, in these regions 12, in a zenith 15 of the pin bores 11 that is enlarged radially towards the inside, a lower surface pressure of the pin on the zenith 15 of the pin bores 11, and therefore in lesser wear of these regions of the pin bores 11, which are subject to the greatest stress in engine operation.

Oil pockets 13 and 14 are formed into the radially inner sides of the piston-crown-side regions 12 of the pin bores 11, the purpose of which pockets consists in storing oil during engine operation, which oil is utilized for improved lubrication of the piston pin (not shown in the figure). This additionally contributes to a reduction in the wear of the piston pin and the pin bore 11.

The oil required for cooling the ring insert 4 is sprayed directly into the cooling channel 5 disposed radially within the ring insert 4, by at least one oil spray nozzle 16, by way of an oil run-in bore 17, in each instance. After passing through the cooling channel 5, the oil exits again from oil run-off bores 18. The oil run-off bores 18 are oriented radially inward and in the direction of the regions 12 of the pin bosses 10, seen in the direction facing away from the piston crown, so that the oil flowing out of the cooling channel 5 hits the piston-crown-side regions 12 of the pin bosses 10, and thereby cools them.

FIG. 2 represents a partial section through the piston 1 in the piston-crown-side region 12 of the pin boss 10 along the line AA in FIG. 1, which shows the shape of the oil pocket 14, in which oil for lubricating the piston pin, not shown in the figures, is stored.

FIG. 3 shows an embodiment of the oil spray nozzle 16, which is connected with an additional spray nozzle 19, whose function consists in cooling the piston-crown-side regions 12 of the pin bosses 10 by means of spraying them directly with oil 20. The spray nozzles 16 and 19 are combined, in the present exemplary embodiment, to form an integrated double spray nozzle 21, which is also disposed on the radially opposite side of the piston 1, in advantageous manner, in order to cool the piston crown there by means of spraying it, as well, and at the same time, to introduce oil into the cooling channel 5 by way of the oil run-in opening situated there.

As shown in the figures, the cooling channel 5 can be part of a cooled ring insert 4. However, it is also possible to dispose the cooling channel 5 at a distance from the ring insert, so that cooling of the combustion bowl 3 is thereby improved. Furthermore, it is sufficient, particularly in the case of smaller pistons, to cool only the pin boss 10, exclusively using a spray nozzle 19, by means of spray-on cooling, whereby the oil pockets 13, 14 for cooling and lubricating the pin boss 10 are filled with cooling oil.

REFERENCE SYMBOL LIST

1 piston
2 piston crown
3 combustion bowl
4 cooled ring insert
5 cooling channel
6 second groove
7 third groove
8 ring belt
9 piston skirt
10 pin boss

11 pin bore
12 piston-crown-side region of the pin boss 10
13, 14 oil pocket
15 zenith of the pin bore 11
16 oil spray nozzle
17 oil run-in bore
18 oil run-off bore
19 spray nozzle
20 oil
21 double spray nozzle
22 piston interior chamber

The invention claimed is:

1. A piston for an internal combustion engine, comprising:
a ring belt disposed on a radial outside of the piston, in the vicinity of a piston crown;
a piston skirt that follows the ring belt in a direction facing away from the piston crown;
a ring-shaped cooling channel disposed in a piston-crown-side edge region of the piston;
at least one oil run-in bore and at least one oil run-off bore, which are each connected with an opening of the cooling channel and empty into an interior chamber of the piston;
pin bosses held by the piston skirt, disposed on radially opposite sides, each having a pin bore, and
at least one oil spray nozzle disposed in an interior chamber of the piston and directed at the at least one oil run-in bore, to introduce cooling oil into the cooling channel,
wherein piston-crown-side regions of the pin bosses are reinforced radially inward, and wherein the oil run-off bores are directed at the reinforced regions of the pin bosses.

2. The piston according to claim 1, wherein oil pockets for short-term storage of oil are formed into the sides of the reinforced regions of the pin bosses that lie radially on the inside.

3. A piston for an internal combustion engine, comprising:
a ring-shaped cooling channel disposed in a piston-crown-side edge region of the piston;
at least one oil run-in bore and at least one oil run-off bore, which are each connected with an opening of the cooling channel and empty into an interior chamber of the piston;
a piston skirt;
pin bosses held by the piston skirt and disposed on radially opposite sides, each having a pin bore; and
at least one oil spray nozzle disposed in an interior chamber of the piston and directed at the at least one oil run-in bore, to introduce cooling oil into the cooling channel,
wherein for cooling of the pin bosses, the at least one oil spray nozzle is connected with an additional spray nozzle, directed at the pin bosses.

4. The piston according to claim 3, wherein piston-crown-side regions of the pin bosses are reinforced radially inward, and wherein the spray nozzles are each directed at a reinforced region of the pin bosses.

5. The piston according to claim 4, wherein oil pockets for short-term storage of oil are formed into the sides of the reinforced regions of the pin bosses that lie radially on an inside.

* * * * *